US010660479B1

(12) United States Patent
Knight

(10) Patent No.: US 10,660,479 B1
(45) Date of Patent: May 26, 2020

(54) RAIL PIN ADJUSTABLE SPA HEADREST

(71) Applicant: New Dimension One Spas, Inc., Chino Hills, CA (US)

(72) Inventor: Mark Knight, Venice, CA (US)

(73) Assignee: New Dimension One Spas, Inc., Chino Hills, CA (US)

( * ) Notice: Subject to any disclaimer, the term of this patent is extended or adjusted under 35 U.S.C. 154(b) by 0 days.

(21) Appl. No.: 16/138,087

(22) Filed: Sep. 21, 2018

Related U.S. Application Data

(60) Provisional application No. 62/561,790, filed on Sep. 22, 2017.

(51) Int. Cl.
*A47K 3/12* (2006.01)
*A47K 3/10* (2006.01)
*A61H 33/00* (2006.01)

(52) U.S. Cl.
CPC ..... *A47K 3/125* (2013.01); *A47K 3/10* (2013.01); *A61H 33/6063* (2013.01); *A61H 2201/1607* (2013.01); *A61H 2205/02* (2013.01); *A61H 2205/04* (2013.01)

(58) Field of Classification Search
CPC ..... A47K 3/125; A47K 3/10; A61H 33/6063; A61H 2201/1607; A61H 2205/02; A61H 2205/04
USPC ..... 4/575.1, 541.1, 541.3, 546, 559
See application file for complete search history.

(56) References Cited

U.S. PATENT DOCUMENTS

| | | | | |
|---|---|---|---|---|
| 4,313,432 | A | 2/1982 | Sievers | |
| 4,339,833 | A | 7/1982 | Mandell | |
| 4,389,740 | A | 6/1983 | Henry | |
| 4,599,753 | A | 7/1986 | Goodman | |
| 4,763,367 | A | 8/1988 | Henkin et al. | |
| 4,764,999 | A | 8/1988 | Rushing | |
| 4,825,854 | A | 5/1989 | Henkin et al. | |
| 4,839,930 | A | 6/1989 | Watkins | |
| 5,333,324 | A | 8/1994 | Pinciaro | |
| 5,335,375 | A | 8/1994 | Madson, Jr. | |
| 5,682,625 | A | 11/1997 | Leaverton et al. | |
| 2014/0131472 | A1* | 5/2014 | Eddington | A61H 33/6063 239/18 |

* cited by examiner

*Primary Examiner* — Tuan N Nguyen
(74) *Attorney, Agent, or Firm* — The Webb Law Firm

(57) ABSTRACT

An adjustable spa headrest has two side surfaces laterally disposed between front and back surfaces. A first projection extends outwardly from one of the side surfaces. A guide rail, positioned for receiving the projection, allows the spa headrest to be positioned in a number of positions. The guide rail includes a horizontal slot, a vertical slot including a number of spaced notches, each notch defined by a pair of second projections, and a spring arm depending in the vertical slot. When the first projection moves to a position between one of the second projections and the spring arm, the spring arm moves away from the second projection whereupon the spring arm applies a spring force to the first projection in a direction of second projection. In response to positioning the first projection in one of the notches, the spring arm secures the first projection in the one of the notches.

19 Claims, 8 Drawing Sheets

Fig. 2
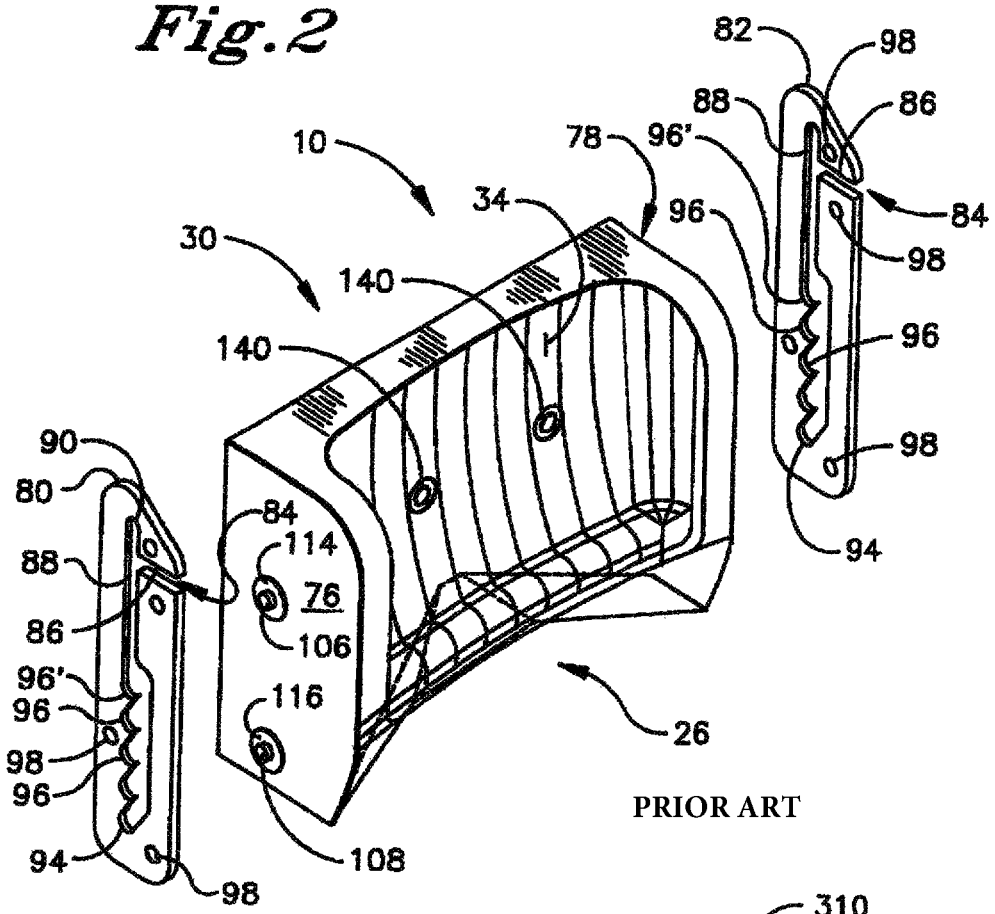
PRIOR ART
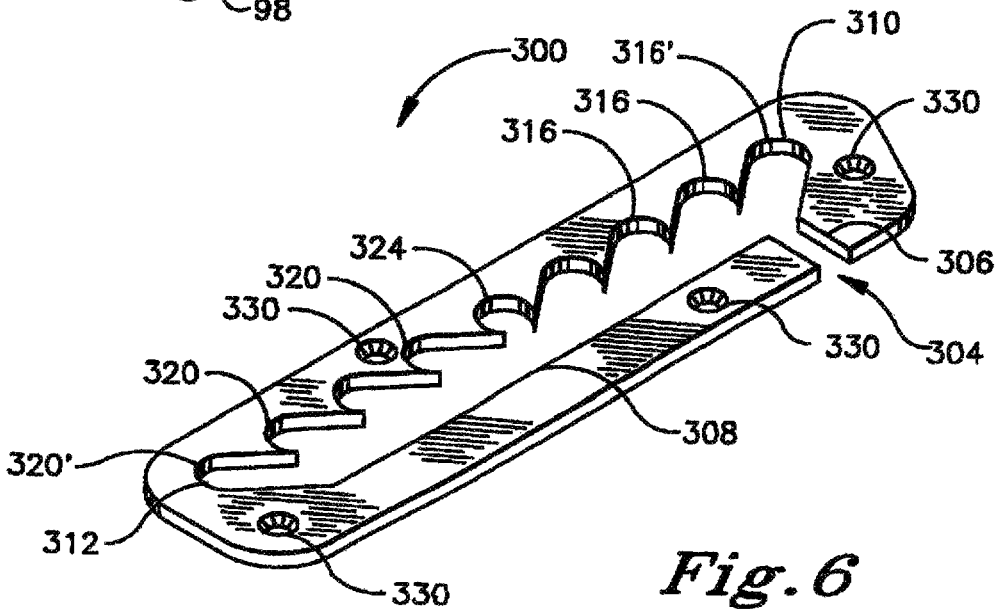
Fig. 6
PRIOR ART

RAIL PIN ADJUSTABLE SPA HEADREST

TECHNICAL FIELD AND CROSS REFERENCE TO RELATED APPLICATION

This invention relates to hot tubs or spas and, more particularly, to hot tubs or spas with an adjustable headrest having integral water jets. The applicant hereby claims the benefit of U.S. Provisional Patent Application No. 62/561,790 filed Sep. 22, 2017. The specification and drawings of said provisional patent application are incorporated herein by this reference as though set forth in full.

BACKGROUND OF THE INVENTION

Background

Hot tubs and spas typically include a spa shell which is made using thermal form techniques. A thermal form sheet of coextruded plastic is typically precut in a particular shape and heated. The heated thermal form sheets are then placed over a mold and vacuum pressure is applied below the mold. The thermal form sheets conform to the mold, take on the shape of the mold and harden after cooling.

While spa shells can be formed in varying sizes and shapes, the cost of designing a spa shell to accommodate a particular occupant, however, is prohibitive. Furthermore, a spa or hot tub is often used by different occupants of varying heights. Often, taller occupants are required to slouch to rest their heads against a headrest or spa ledge during spa use. Shorter occupants may not be tall enough to rest their heads against fixed headrests. Thus, a spa or hot tub which can be adjusted to fit a particular user would be desirable and advantageous.

Hydrotherapy aerated water jets have been designed to provide a turbulent mix of hot water and air under pressure for impacting an occupant of a spa or hot tub to provide a therapeutic benefit to the occupant. In the past, the aerated water jets have been positioned below the water line to minimize splash. As a result, the therapeutic benefits are limited to body parts which are typically positioned below the water line during use. Unfortunately, the neck of an occupant is typically positioned above the water line and often requires therapeutic attention. Thus, a spa or hot tub providing therapeutic benefits to the occupant's neck would also be both advantageous and desirable. Furthermore, a device providing therapeutic benefits to the occupant's neck should be adjustable to reach different parts of the occupant's neck, head and upper shoulders and to accommodate occupants of varying heights.

Despite significant advancements in the art of hot tub and spa design, there still exists a need for hot tubs or spas which provide additional therapeutic benefits and which are readily adjustable to fit occupants of varying heights.

SUMMARY OF THE INVENTION

An adjustable headrest for a spa tub according to the present invention includes a housing for supporting the head of an occupant. A spa tub defines a first recess for slidingly receiving said housing. A positioning means, coupled to said housing and said first recess of said spa tub, adjusts the height of said housing relative to said spa tub.

According to other features of the invention, a front surface of said housing and said a pillow lie flush with adjacent surfaces of said spa tub to prevent discomfort. The adjustable headrest further includes first water propelling means, mounted on said housing below said pillow, for directing water under pressure towards the neck of the occupant.

In another feature of the invention, the adjustable headrest further includes adjustment means, associated with said first water propelling means, for changing the direction of said water exiting said first water propelling means.

In another feature of the invention, the positioning means further includes a plurality of projections extending outwardly from sides of said housing and guide means, located in said first recess, for receiving said plurality of projections and for allowing said housing to be positioned in a plurality of fixed positions.

In still other features of the invention, the guide means includes first and second guide rails each defining a horizontal slot, a vertical slot and a plurality of spaced notches. An annular-shaped raised surface formed around at least one of said projections on said housing reduces friction by decreasing the surface area of said housing in contact with said first and second guide rails.

In still another feature of the invention, the adjustable headrest further includes second water propelling means, for projecting a mixture of water and air at the shoulders of the occupant.

A height-adjustable water jet for directing water at the neck of an occupant of a spa tub according to another aspect of the invention includes a housing and a water propelling means, mounted on said housing, for directing water under pressure towards the neck of the occupant. A spa tub includes a recess for slidingly receiving said housing. A positioning means, coupled to said housing and said recess of said spa tub, adjusts the height of said housing and said water propelling means and fixes the height of said housing in one of a plurality of selectable positions.

An adjustable-height headrest with water jet for a spa tub according to another aspect of the invention includes a housing having a first recess for receiving a pillow for supporting the head of an occupant. A spa tub includes a second recess for slidingly receiving said housing. A positioning means, coupled to said housing and said spa tub, adjusts the height of said housing relative to said recess of said spa tub. A water propelling means, mounted on said housing below said pillow, directs water under pressure towards the neck of the occupant.

An adjustable-height headrest with a direction-adjustable water jet for a spa tub according to still another aspect of the invention includes a housing defining a first recess for receiving a pillow for supporting the head of an occupant. A spa tub defines a second recess for slidingly receiving said housing. A positioning means, coupled to said housing and said spa tub, adjusts the height of said housing relative to said second recess of said spa tub. A water propelling means, mounted on said housing, directs water under pressure towards the neck of the occupant. An adjustment means, associated with said water propelling means, changes the direction of said water exiting said water propelling means.

Disclosed here is an adjustable headrest for a spa tub including: a spa tub defining a spa tub recess; a housing slidingly received by said spa tub recess for supporting the head of an occupant having a front surface, a back surface, and two side surfaces laterally disposed between said front surface and said back surface; and a positioning arrangement, coupled to said housing and located in said spa tub recess, for adjusting the height of said housing relative to said spa tub. The positioning arrangement includes a first projection extending outwardly from one of said side surfaces of said housing and a guide rail, located in said spa tub recess opposite said one of said side surfaces, for receiving said projection and for allowing said housing to be positioned in a plurality of fixed positions. The guide rail includes a substantially planar guide rail defining a horizontal slot, a vertical slot, a plurality of spaced notches, and a spring arm depending in said vertical slot spaced from said notches. Each notch is defined by a pair of second projections. The spring arm has a spring memory. In response to positioning the first projection between one of said second projections and the spring arm, the spring arm moves away from the one of said second projections and applies a force to the first projection in a direction of second projection. In response to positioning the first projection in one of said notches, the spring arm secures the first projection in the one of said notches.

The horizontal slot, the vertical slot, the plurality of notches, and the spring arm can all be within a common plane.

In response to positioning the first projection in one of said notches, the spring memory of the spring arm can causes the spring arm to urge the first projection in the one of said notches.

Other objects, features and advantages will be readily apparent.

BRIEF DESCRIPTION OF THE DRAWINGS

The various advantages of the present invention will become apparent to those skilled in the art after studying the following specification and by reference to the drawings in which:

FIG. 2 is a perspective view of the adjustable headrest and headrest guide rails according to the prior art U.S. Pat. No. 5,682,625;

FIG. 6 is a perspective view of an alternate headrest guide rail according to the prior art of U.S. Pat. No. 5,682,625.

DESCRIPTION OF THE INVENTION

Figure 1:
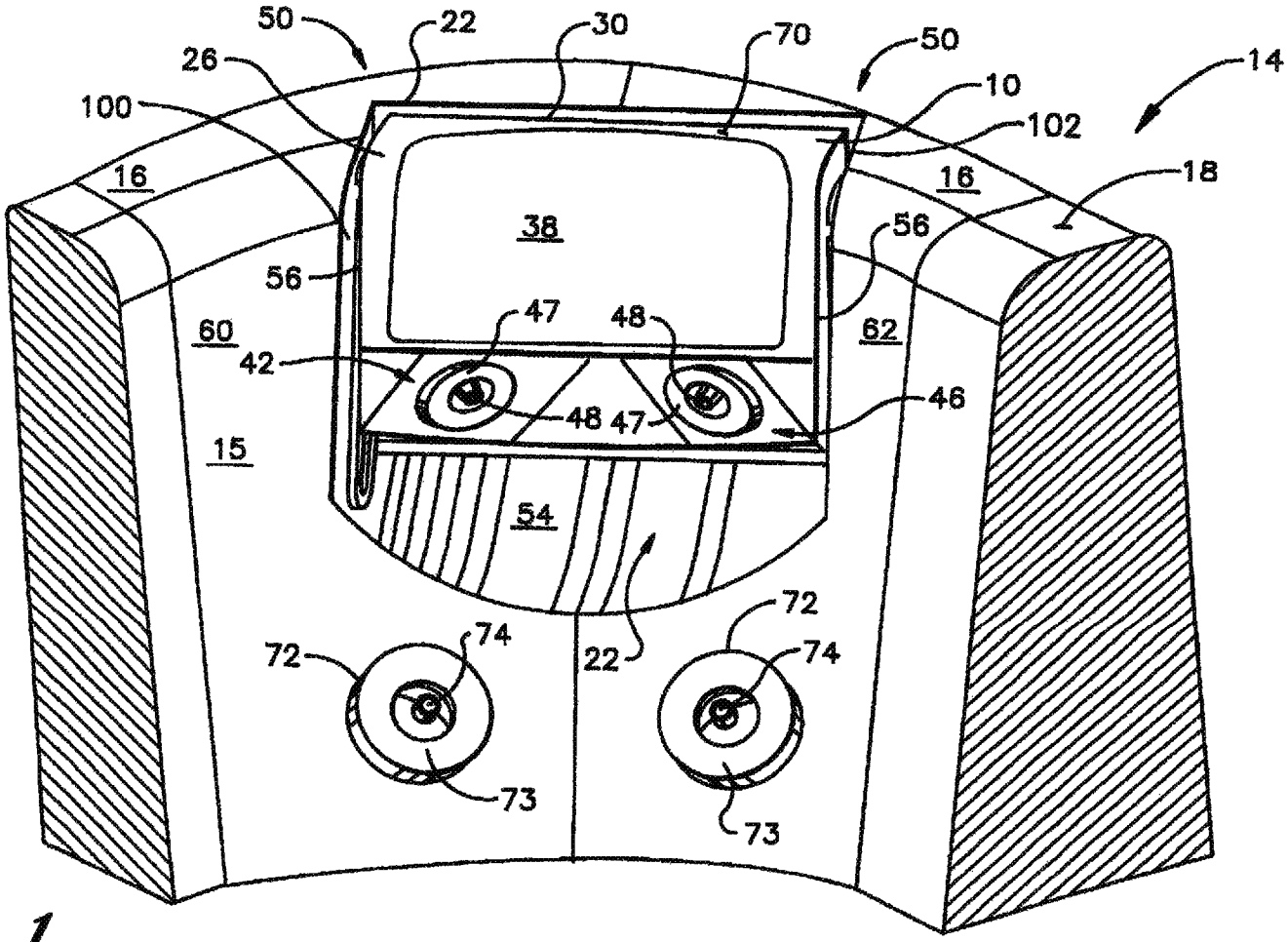
Fig. 1 PRIOR ART
FIG. 1 is a front perspective view of a spa incorporating an adjustable headrest having integral adjustable neck water jets according to the prior art U.S. Pat. No. 5,682,625 and the present invention.

Various non-limiting examples will now be described with reference to the accompanying figures where like reference numbers correspond to like or functionally equivalent elements.

For purposes of the description hereinafter, the terms "end," "upper," "lower," "right," "left," "vertical," "horizontal," "top," "bottom," "lateral," "longitudinal," and derivatives thereof shall relate to the example(s) as oriented in the drawing figures. However, it is to be understood that the example(s) may assume various alternative variations and step sequences, except where expressly specified to the contrary. It is also to be understood that the specific example(s) illustrated in the attached drawings, and described in the following specification, are simply exemplary examples or aspects of the invention. Hence, the specific examples or aspects disclosed herein are not to be construed as limiting.

Referring to FIGS. 1 and 2, the environment for the presently preferred embodiment of an adjustable headrest 10 for a hot tub or spa 14 is disclosed and illustrated. FIGS. 1-6 describe a prior art adjustable spa headrest according to U.S. Pat. No. 5,682,625, which is herein incorporated by reference. The views presented in FIGS. 1, 3, 4 and 5 are also in accord with the configuration of the adjustable headrest in a preferred embodiment of the present invention. Spa 14 includes a spa shell 18 which defines a seat portion (not shown), a back portion 15, and an upper ledge 16. Skilled artisans can appreciate that spa shell 18 can have many different sizes and shapes and that the shape illustrated in FIG. 1 is merely but one example. Furthermore, skilled artisans can appreciate that adjustable headrest 10 can be located in positions other than the corner position of spa 14 illustrated in FIG. 1. Spa shell 18 defines a first recess 22 for receiving adjustable headrest 10. First recess 22 of FIG. 1 preferably has an elongate rectangular cross-section and provides sufficient clearance to allow adjustable headrest 10 to be raised and lowered relative to spa shell 18.

Adjustable headrest 10 includes a front side 26 and a rear side 30. An upper portion of front side 26 of adjustable headrest 10 defines a second recess 34 (FIG. 2) for receiving a headrest pillow 38. Adjustable headrest 10 further includes first and second water jets 42 and 46 which are located below pillow 38 on a lower portion of front side 26. First and second water jets 42 and 46, preferably located above a water line during use, move with adjustable headrest 10 and direct a jet of water at the hot tub occupant's neck, head or upper shoulders. Preferably, first and second water jets 42 and 46 are oriented in a downwardly facing direction to minimize water splashing outside of spa 14. First and second water jets 42 and 46 each include an outer bezel 47 which can be rotated in one direction to increase water pressure and in an opposite direction to decrease water pressure. First and second water jets 42 and 46 further include a nozzle 48 which can be adjusted to change the direction of water output therefrom.

An adjustment device 50 is located between adjustable headrest 10 and first recess 22 of spa shell 18 to allow the height of adjustable headrest 10 to be adjusted relative to spa shell 18. A concave lower portion 54 of first recess 22 provides clearance for water exiting first and second water jets 42 and 46 when adjustable headrest 10 is in the lower positions as will be described in further detail below. Preferably, opposing front sides 56 and 58 of adjustable headrest 10 are approximately flush with adjacent surfaces 60 and 62 of spa shell 18 to provide a comfortable surface for an occupant to rest against.

Preferably, adjustable headrest 10 can be selectively and easily adjusted in a plurality of fixed-height positions relative to spa shell 18. In a highly preferred embodiment, adjustable headrest 10 can be raised to an upper position with an upper surface 70 of adjustable headrest 10 lying above ledge 16, to a lower position with upper surface 70 lying below ledge 16, and to one or more intermediate positions. Preferably in one intermediate position, upper surface 70 of adjustable headrest 10 lies flush to ledge 16.

Spa shell 18 further includes one or more water jets 72, preferably located below the water line during use, which selectively directs either water or aerated water at the shoulders of the hot tub occupant. Water jets 72 preferably include a nozzle 74 which can be directionally adjusted. Preferably water jet 72 can also be adjusted to provide variable water pressure (using outer bezel 73) and air pressure mixtures (by adjusting nozzle 74).

Referring to FIG. 2, adjustable headrest 10 and portions of adjustment device 50 are illustrated in greater detail. For purposes of clarity, reference numbers from FIG. 1 have been used where appropriate. Pillow 38 has been omitted to illustrate second recess 34. Adjustable headrest 10 further includes sides 76 and 78.

In a preferred embodiment, adjustment device 50 includes first and second guide rails 80 and 82 each having a "C"-shaped cross section. First and second guide rails 80 and 82 include an opening 84 into a horizontal slot 86 which is connected to a vertical slot 88. First and second guide rails 80 and 82 further include an upper stop 90 located in an upper portion of vertical slot 88 and a lower stop 94 located in a lower portion of vertical slot 88. First and second guide rails 80 and 82 include a plurality of notches 96 (the bottom-most notch corresponds to lower stop 94).

A plurality of fasteners connect first and second guide rails 80 and 82 to opposing flat surfaces 100 and 102 of first recess 22 (FIG. 1). In a preferred embodiment, first and second guide rails 80 and 82 include a plurality of bores 98 for receiving screws (not shown).

Adjustment device 50 further includes upper and lower projections 106 and 108 extending outwardly from opposite sides 76 and 78 of adjustable headrest 10. Upper and lower projections 106 and 108 are slidably received in horizontal and vertical slots 86 and 88 of first and second guide rails 80 and 82. In a highly preferred embodiment, adjustable headrest 10 includes first and second raised annular surfaces 114 and 116 surrounding upper and lower projections 106 and 108. First and second raised annular surfaces 114 and 116 reduce sliding friction by decreasing the surface area of sides 76 and 78 in contact with first and second guide rails 80 and 82, respectively.

Figure 3:
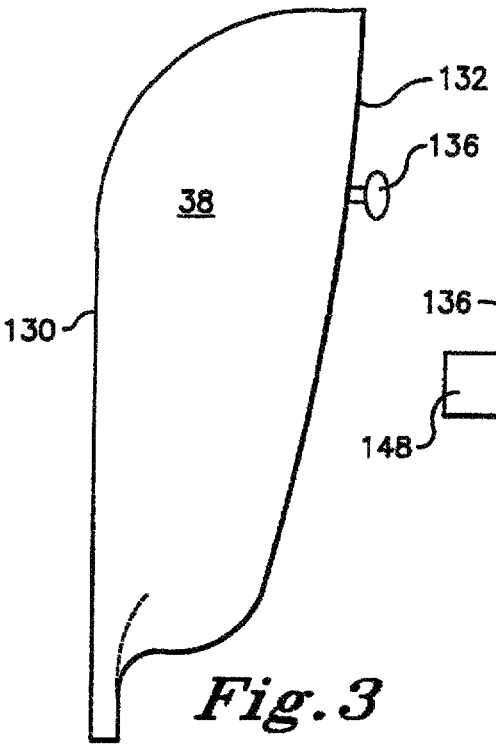
Fig. 3 PRIOR ART
FIG. 3 is a side view of a pillow shown on the adjustable headrest of FIG. 1.
Figure 4:
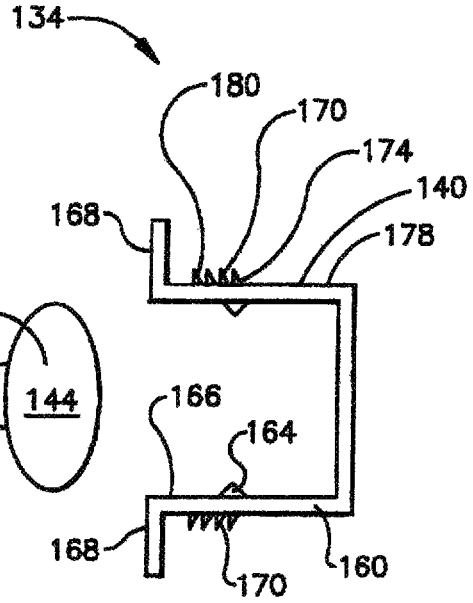
Fig. 4 PRIOR ART
FIG. 4 is a side cross sectional view of a pillow fastener including male and female connectors for attaching the pillow of FIG. 3 to the adjustable headrest of FIG. 1.

Referring to FIGS. 2, 3 and 4, front and rear surfaces 130 and 132 of pillow 38 are illustrated. A fastening device 134 connects pillow 38 to adjustable headrest 10. Fastening device 134 preferably includes one or more male connectors 136 which are connected to and extend rearwardly from a rear surface 132 of pillow 38. One or more female connectors 140 are received in a bore formed in adjustable headrest 10 (FIG. 2). Skilled artisans can appreciate that the position of male and female connectors 136 and 140 can be switched. In other words, male connector 136 can be located on adjustable headrest 10 and female connector 140 can be located on rear surface 132 of pillow 38.

In a highly preferred embodiment, male connector 136 includes an oval shaped upper portion 144 connected to a cylindrical base 148 having a smaller outer diameter than the oval upper portion 144. Female connector 140 resembles a top hat and includes a cylindrical housing 160 having an annular projection 164 on an inner surface 166 thereof. Female connector 140 includes an annular flange 168 and a plurality of raised notches 170 having a leading surface 174 which is inclined relative to an outer surface 178 of the female connector 140. A trailing surface 180 of raised notches 170 is perpendicular to outer surface 178. As can be appreciated, the force required to insert female connector 140 into the bore in adjustable headrest 10 is markedly less than the force required to remove female connector 140. Thus, female connector 140 remains in position when pillow 38 is repeatedly attached to and detached from adjustable headrest.

Figure 5:
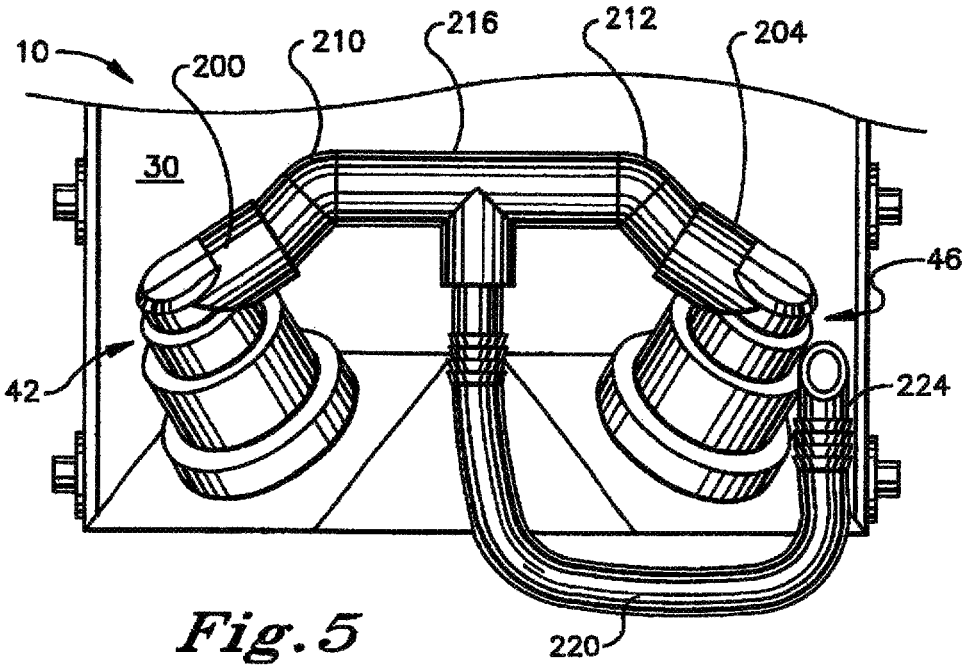
Fig. 5 PRIOR ART
FIG. 5 is a rear view of the adjustable headrest of FIG. 2 illustrating the plumbing for the adjustable neck water jets illustrated in FIG. 1.

Referring to FIG. 5, rear side 30 of adjustable headrest 10 is illustrated. First and second water jets 42 and 46 include jet bodies 200 and 204, respectively. Because nozzles 48 of first and second water jets 42 and 46 are located above the water line, preferably air is not introduced. Elbow connectors 210 and 212 and a "T"-shaped connector 216 join plumbing to jet bodies 200 and 204. A corrugated section of tubing 220 and an elbow connector 224 couple jet bodies 200 and 204 to a back wall of first recess 22 of spa shell 18. A source of pressurized water is preferably located beneath spa shell 18 and is connected to elbow connector 224.

In a highly preferred embodiment, spa shell 18 is fabricated using conventional thermal form techniques. Adjustable headrest 10 and first and second water jets 42 and 46 are made from injection molded plastic. First and second water jets 42 and 46 (modified by removing air inputs) are manufactured by Waterway Plastics, Inc. of Oxnard, Calif. Outer bezels 47 thereof can be rotated to increase or decrease water pressure of first and second water jets 42 and 46. Nozzle 48 of first and second water jets 42 and 46 can be pivoted to adjust the direction of the water.

An outer bezel 73 of water jet 72 can be rotated to increase or decrease output water pressure. Nozzle 74 of water jet 72 can be pivoted to adjust the direction of the water. By moving the nozzle 74 inwardly and outwardly, the air pressure can be decreased or increased. Water jet 72 can also be made in accordance with "Adjustable Spa Nozzle", U.S. Pat. No. 5,495,627, hereby incorporated by reference.

In use, adjustable headrest 10 is removably connected in recess 22 of spa shell 18. To connect adjustable headrest 10, lower projections 108 on opposite sides 76 and 78 are consecutively inserted into openings 84, horizontal slots 86, and vertical slots 88 of first and second guide rails 80 and 82. Lower projections 108 are initially moved in an inwardly direction into horizontal slots 86. Then, lower projections 108 are moved in a downwardly direction into vertical slots 88 until upper projection 106 can be inserted in opening 84 and horizontal slot 86. Once upper projection 106 reaches vertical slot 88, the height of adjustable headrest 10 can be readily adjusted to properly fit the occupant. The adjustable headrest 10 is held in place by positioning lower projection 108 in notches 96.

When upper projections 106 lie adjacent upper stop 90 and lower projections 108 are in the upper notch 96, adjustable headrest 10 is in the highest position. When lower projection 108 abuts the lowest notch 94, adjustable headrest 10 is in the lowest position. Preferably when lower projections 108 are positioned in notches 96, upper projections 106 are not aligned with horizontal slot 86 to prevent forward movement of adjustable headrest 10.

As can be appreciated from the foregoing, the present invention provides a headrest which can be readily adjusted to accommodate occupants of differing heights. Advantageously, the adjustable headrest includes water jets which are likewise readily adjustable to accommodate occupants of differing heights. By allowing adjustment, the spa tub according to the present invention improves the effectiveness of the hydrotherapy. The adjusting mechanism for the headrest is easy to use. Adjustment can be made by someone inside or outside of the spa. Adjustments can be made quickly and without tools. The outer front surface of the pillow is relatively flush with the spa shell for comfort.

Referring to FIG. 6, an alternate guide rail 300 is illustrated. Like first and second guide rails 80 and 82, guide rail 300 has a "C"-shaped cross section. Skilled artisans can appreciate that a second guide rail similar to (or a mirror image of) guide rail 300 would be employed. Guide rail 300 includes an opening 304 and a horizontal slot 306 connected to a vertical slot 308. Guide rail 300 further includes an upper stop 310 and a lower stop 312 located at opposite ends of vertical slot 308. Vertical slot 308 further includes a plurality of upwardly-facing notches 316, a plurality of downwardly-facing notches 320, and a center notch 324. As with first and second guide rails 80 and 82, a plurality of fasteners connect guide rails 300 to opposing flat surfaces 100 and 102 of first recess 22 (FIG. 1). In a preferred embodiment, the fasteners screws (not shown) are received in bores 330.

When using guide rails 300, adjustable headrest 10 can likewise be positioned at a plurality of different fixed heights relative to spa shell 18. To connect adjustable headrest 10 using guide rails 300, lower projections 108 on opposite sides 76 and 78 are consecutively inserted through opening 304, into horizontal slot 306, and into vertical slot 308 of guide rail 300. Lower projections 108 are moved in a downwardly direction until upper projection 106 can be aligned with opening 304 and into horizontal slot 306. Once upper projection 106 reaches vertical slot 308, the height of adjustable headrest 10 can be readily adjusted to support an occupant's head and be held in place using notches 96. When upper projection 106 lies adjacent upper stop 310 in notch 316', the lower projection 108 snap-fits into center notch 324 and adjustable headrest 10 is in the highest position. When lower projection 108 lies adjacent lower stop 312 in the lowest notch 320', the upper projection 106 snap-fits into center notch 324 and adjustable headrest 10 is in the lowest position. When lower projection 108 lies in the notches 320 above the lowest notch 320', the upper projection 106 snap-fits into notches 316 above center notch 324 and adjustable headrest 10 is in an intermediate position.

As can be appreciated, guide rail 300 allows adjustable headrest 10 to be more readily held in a fixed position by snap-fitting into a fixed position and by providing a more positive "locked" feel.

Figure 7:
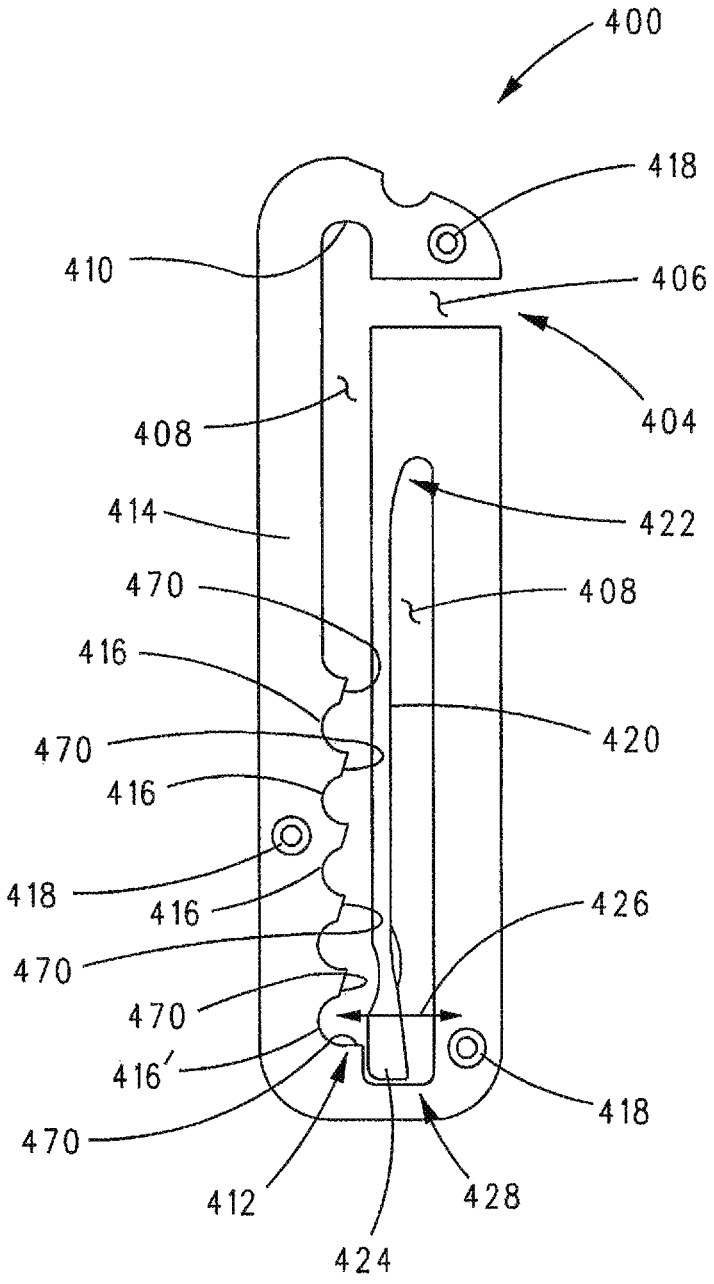
FIG. 7 is a plan view of another example headrest guide rail.

With reference to FIG. 7, another example guide rail 400 made in accordance with the present invention, similar in many respects to guide rail 80, has an opening 404 and a horizontal slot 406 connected to a vertical slot 408. Guide rail 400 further includes an upper stop 410 and a lower stop 412 at opposite ends of vertical slot 408. A side 414 of guide rail 400 opposite horizontal slot 406 includes, at a lower end of vertical slot 408, for example, a plurality of notches 416 that face vertical slot 408.

A side of vertical slot 408 opposite notches 416 includes a spring arm 420 that projects or depends into vertical slot 408, whereupon portions of vertical slot 408 can be on opposite sides of spring arm 420. A first, proximal end 422 of spring arm 420 is affixed proximate horizontal slot 406. A second, distal end 424 of spring arm 420, positioned proximate a bottom end 428 of vertical slot 408 and a lowest notch 416', is free to move within vertical slot 408 in a plane toward and away from notches 416 in the directions shown by two-headed arrow 426.

In an example, guide rail 400 includes five notches 416 along the length of side 414, with the lowest notch 416' positioned proximate bottom end 428. However, the number of notches 416 and the positions of notches 416 along the length of side 414 are not to be construed in a limiting sense.

At least spring arm 420 is made from a material that has a spring memory that allows the second distal end 424 of spring arm 420 and the length of spring arm 420 between first proximal end 422 and second distal end 424 to move in the directions shown by two-headed arrow 426 and return to the position shown in FIG. 7, where spring arm 420 is in a relaxed (unsprung) state where spring arm is not exerting a force in either direction shown by two-headed arrow 426. When moved in either direction shown by two-headed arrow 426, the spring memory of the material forming spring arm 420 urges spring arm 420 to return to the relaxed (unsprung) positon shown in FIG. 7.

Figure 8:
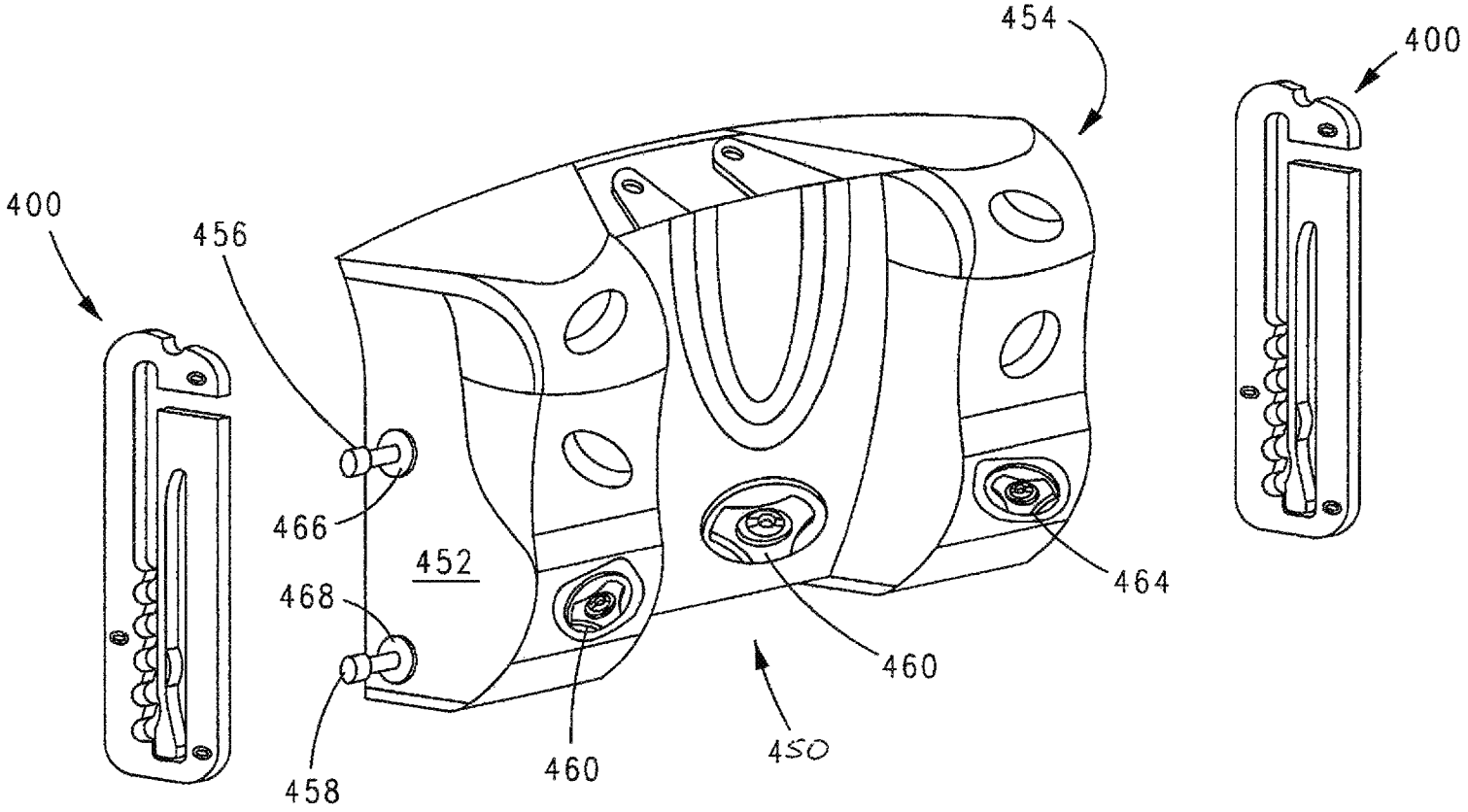
FIG. 8 is a perspective view of another example adjustable headrest with two instances of the headrest guide rails shown in FIG. 7.

Referring to FIG. 8 and with continuing reference to FIG. 7, a pair of guide rails 400 is positioned on opposite sides 452 and 454 of another example adjustable headrest 450 is shown in FIG. 8. Except as illustrated or described, adjustable headrest 450 has features similar to adjustable headrest 10. For the purpose of simplify, these similar features will not be described to avoid unnecessary redundancy.

Each opposite sides 452 and 454 of adjustable headrest 450 includes an upper projection 456 and a lower projection 458. Only upper and lower projections 456 and 458 on side 452 are shown in FIG. 8.

Each opposite sides 452 and 454 can include raised annular surfaces 466 and 468 that can surround proximal ends of upper and lower projections 456 and 458, respectively, for reducing sliding friction by decreasing the surface area of said side in contact with a guide rail 400.

Adjustable headrest 450 can further include water jets 460, 462, and 464 spaced between opposite sides 452 and 454 proximate a bottom side 466 of adjustable headrest 450. In use of adjustable headrest 450 with spa shell 18, for example, water jets 460, 462, and 464 can be positioned above or below a water line and can move with adjustable headrest 450.

In use, adjustable headrest 450 can be removably connected in recess 22 of spa shell 18. To connect adjustable headrest 450, the lower projection 458 on each opposite side 452 and 454 is consecutively inserted into opening 404, horizontal slot 406, and into the portion of vertical slot 408 between side 414 and horizontal slot 406. The lower projection 458 is then moved in an downwardly direction into the portion of vertical slot 408 between side 414 and spring arm 420 until the upper projection 456 on the same side (452 or 454) can be inserted in opening 404 and horizontal slot 406. Once upper projection 456 reaches vertical slot 408, the height of adjustable headrest 450 can be readily adjusted upwardly or downwardly to properly fit the occupant. Adjustable headrest 450 is held in place by positioning lower projection 458 in one of notches 416.

Each guide rail 400 can include bores 418 for receiving fasteners that can be used to couple guide rails 400 to adjacent surfaces 60 and 62 of spa shell 18, thereby securing adjustable headrest 450 to spa shell 18 when upper and lower projections 456 and 458 on opposite sides 452 and 454 are received in vertical slots 408.

When upper projections 456 are positioned proximate upper stop 410 of guide rails 400 and lower projections 458 are in uppermost notches 416 of guide rails 400, adjustable headrest 450 is in the highest position. When lower projections 458 are in lowest notches 416' of guide rails 400, adjustable headrest 450 is in the lowest position. In an example, when lower projections 458 are positioned in notches 416 of guide rails 400, upper projections 456 are not aligned with horizontal slots 406 to avoid forward movement of adjustable headrest 450.

Figure 9:
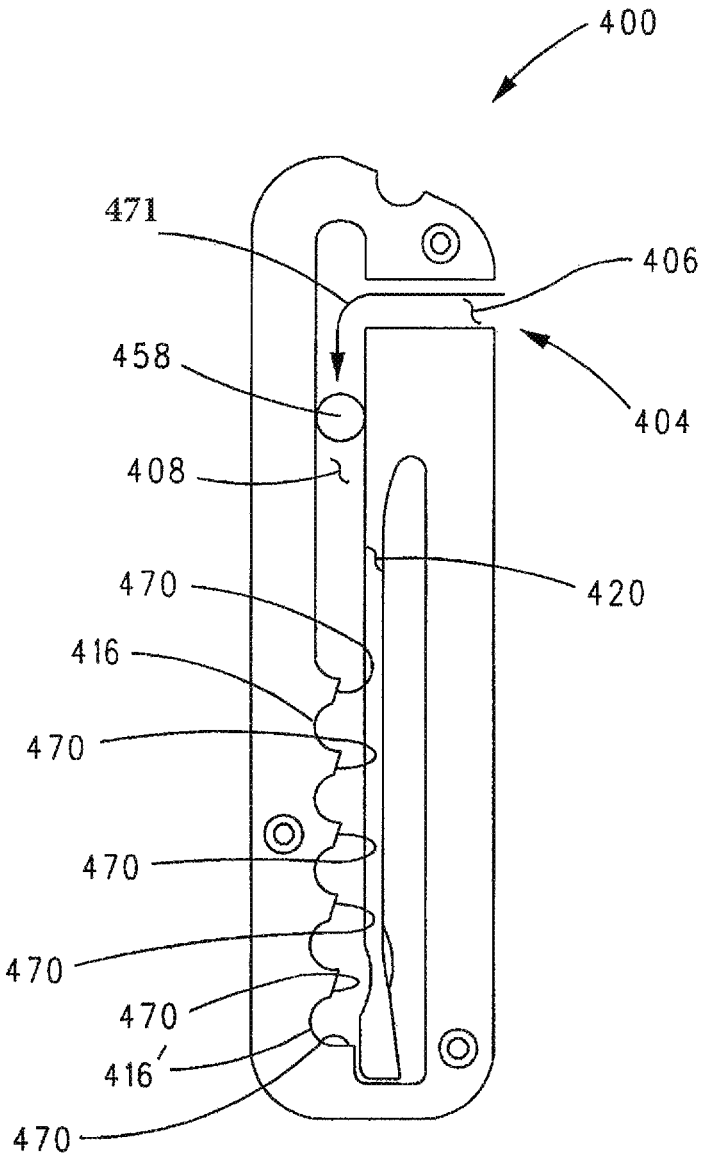
FIGS. 9-11 are views of the progressive insertion of a lower projection of the example adjustable headrest of FIG. 8 into the vertical and horizontal slots of the example headrest guide rail of FIG. 7, and the position of the upper projection of the example adjustable headrest of FIG. 8 (FIG. 11) after the lower projection is seated in a desired notch of the example headrest guide rail.
Figure 10:
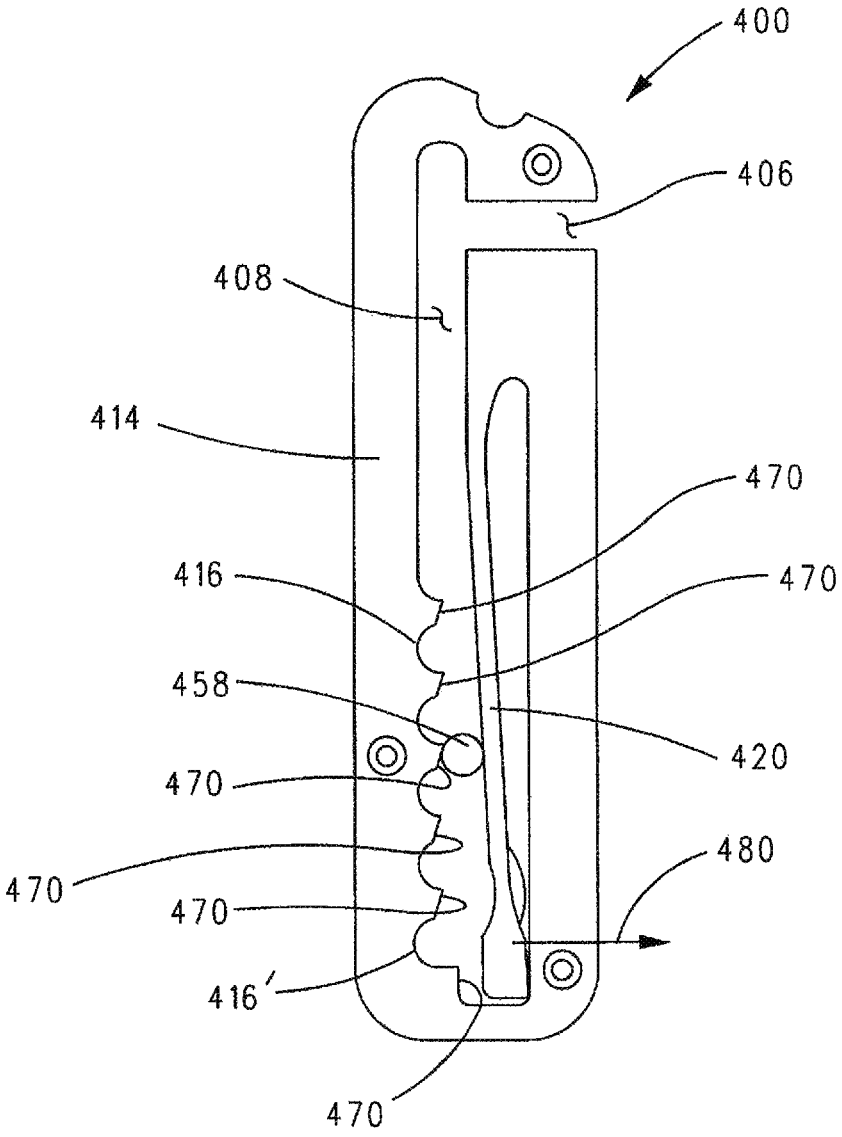
Figure 11:
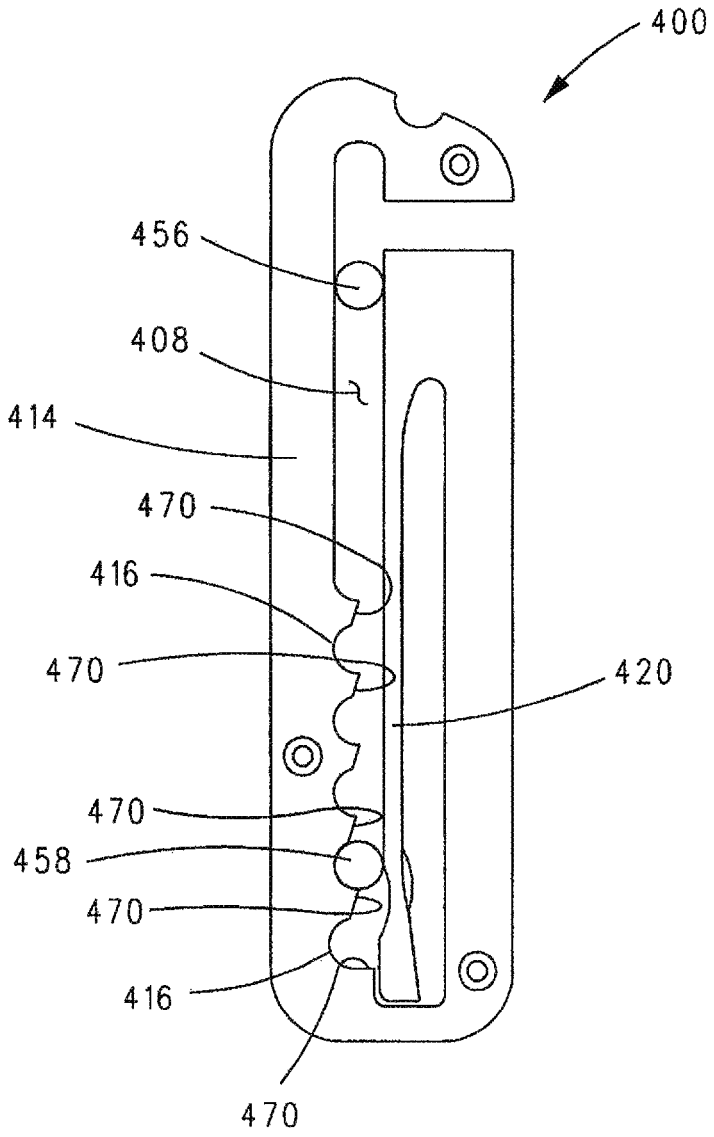

With reference to FIGS. 9-11, the operation of spring arm 420 in response to insertion of an instance of lower projection 458 into an instance of vertical slot 408 will now be described.

Initially, lower projection 458 is inserted into the part of vertical slot 408 above notches 416 via opening 404 and horizontal slot 406, as shown by curved arrow 471. Next, lower projection 458 is moved downward into horizontal slot 406 proximate notches 416. As can be seen in FIGS. 7-11, pairs of projections 470 of side 414 define each notch 416, i.e., each notch 416 includes a projection 470 on each side of said notch 416. As lower projection 458 moves past each projection 470, a side of lower projection 458 opposite said projection 470 bears against spring arm 420, which, in response, moves away from side 414 in a direction shown by arrow 480 in FIG. 10.

As lower projection 458 moves past each projection 470 and into a notch 416, the spring memory of spring arm 420 can cause spring arm 420 to return to its relaxed position shown in FIG. 11, whereupon the spring memory of spring arm 420 in its relaxed (unsprung) state can hold lower projection 458 in said notch 416. Alternatively, when lower projection 458 is positioned in a notch 416, spring arm 420 may not return to its relaxed position. Rather, lower projection 458 may cause spring arm 420 to be offset somewhat from its relaxed (unsprung) state in a direction of arrow 480 in FIG. 10, whereupon the spring memory of spring arm 420 is in a sprung state whereupon spring arm 420 bears against lower projection 458 in a direction opposite arrow 480 in FIG. 10 urging lower projection 458 into said notch 416 so as to biasly maintain lower projection 458 in the respective notch 416. A sufficient vertical force on the guide rails 400 via the adjustable headrest 450 is required to disengage the lower projections 458 from their respective notches 416 to adjust the adjustable headrest 450 or to remove adjustable headrest 450.

As lower projection 458 moves past each projection 470 and into a notch 416, the spring memory of spring arm 420 causes spring arm 420 to return to its relaxed (unsprung) state or to a sprung state where spring arm 420 bears against lower projection 458 urging lower projection 458 into said notch 416.

Lower projection 458 can be moved downward in vertical slot 408 past each projection 470 until lower projection 458 is received in a desired notch 416 and is secured therein by spring arm 420 in its relaxed (unsprung) state or sprung state and upper projection 456 is positioned in an upper portion of vertical slot 408, as shown for example in FIG. 11.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. An adjustable headrest for a spa tub comprising:

a spa tub defining a spa tub recess;

a housing slidingly received by said spa tub recess for supporting the head of an occupant having a front surface, a back surface, and two side surfaces laterally disposed between said front surface and said back surface;

a first projection extending outwardly from one of said side surfaces of said housing; and a guide rail, located in said spa tub recess opposite said one of said side surfaces, for receiving said projection and for allowing said housing to be positioned in a plurality of fixed positions for adjusting the height of said housing relative to said spa tub, wherein:

said guide rail is substantially planar defining a horizontal slot, a vertical slot, a plurality of spaced notches, and a spring arm depending in said vertical slot spaced from said notches; and each notch is defined by a pair of second projections, wherein:

the spring arm has a spring memory;

in response to positioning the first projection between one of said second projections and the spring arm, the spring arm moves away from the one of said second projections and applies a force to the first projection in a direction of second projection; and in response to positioning the first projection in one of said notches, the spring arm secures the first projection in the one of said notches.

2. The adjustable head rest of claim 1, wherein said horizontal slot, said vertical slot, said plurality of notches, and said spring arm are all within a common plane.

3. The adjustable head rest of claim 1, wherein in response to positioning the first projection in one of said notches, the spring memory of the spring arm causes the spring arm to urge the first projection in the one of said notches.

4. The adjustable head rest of claim 2, wherein in response to positioning the first projection in one of said notches, the spring memory of the spring arm causes the spring arm to urge the first projection in the one of said notches.

5. The adjustable headrest of claim 1, further comprising an adjustable water jet mounted on said front surface of said housing wherein said adjustable water jet is configured to direct water under pressure towards the neck or shoulders of said occupant.

6. The adjustable headrest of claim 1, wherein said housing defines a recess for receiving a pillow for supporting the head of said occupant.

7. An adjustable headrest for a spa tub comprising:

a housing for supporting the head of an occupant comprising a front surface, two side surfaces, and a back surface;

a pillow mounted on said front surface of said housing for further supporting the head of an occupant;

an adjustment device coupled to the side surfaces of said housing and said spa tub for adjusting the height of said housing relative to said spa tub and forcibly positioning said housing into one of a plurality of fixed positions; and a water propelling device mounted on said housing below said pillow for directing water under pressure towards the occupant;

wherein said adjustment device comprises a plurality of projections extending outwardly from said side surfaces of said housing and a guiding structure located on said spa tub for receiving said plurality of projections and for forcing said housing to be releaseably positioned in one said plurality of fixed positions, the guiding structure comprising a first guide rail comprising a moveable spring arm having a spring memory for engaging and releasably fixing in position at least one of said plurality of projections extending outwardly from one of said side surfaces of said housing and a second guide rail comprising a moveable spring arm having spring memory for engaging and releaseably fixing in position at least one of said plurality of projections extending outwardly from the other of said side surfaces of said housing.

8. The adjustable headrest of claim 7, wherein said first and second guide rails each further define a horizontal slot, a vertical slot, and a plurality of spaced notches for slidingly engaging at least one of said plurality of projections extending outwardly from each side surface of said housing.

9. The adjustable headrest of claim 8, wherein said horizontal slot, said vertical slot, said plurality of notches, and said spring arm are all within a common plane.

10. The adjustable headrest of claim 8, wherein in response to positioning one of said projections in one of said notches, the spring memory of the spring arm causes the spring arm to urge the one said projection in the one of said notches.

11. The adjustable headrest of claim 7, further comprising adjustment means for changing the direction of said water exiting said water propelling means to direct water under pressure towards different parts of the body of said occupant.

12. The adjustable headrest of claim 7, wherein said water propelling device comprises a water jet configured to allow adjustment of the direction said water is propelled.

13. An adjustable headrest for a spa tub defining a recess comprising:

a housing receivable by said recess in said spa tub for supporting the head of an occupant comprising a front surface, a first side surface, a second side surface, and a back surface;

a pillow mounted on said front surface of said housing for further supporting the head of an occupant;

a plurality of projections extending outwardly from said first and second side surfaces of said housing;

a first guide rail comprising a moveable spring arm having a spring memory mounted in said recess of said spa tub opposite to said first side surface of said housing wherein said first guide rail is configured to adjustably engage at least one of said plurality of projections extending outwardly from said first side surface of said housing such;

a second guide rail comprising a moveable spring arm having a spring memory mounted in said recess of said spa tub opposite to said second side surface of said housing wherein said second guide rail is configured to adjustably engage at least one of said plurality of projections extending outwardly from said second side surface of said housing; and a water jet mounted on said front of said housing below said pillow for directing water under pressure towards the occupant.

14. The adjustable headrest of claim 13, wherein said first and second guide rails each further define a horizontal slot, a vertical slot, and a plurality of spaced notches configured to receive at least one of said plurality of projections extending outwardly from said first and second side surfaces of said housing and wherein said spring arms on said first and second guide rails depend from said vertical slot to engage and releaseably fix the positon of at least one of said plurality of projections.

15. The adjustable headrest of claim 14, wherein said first and second guide rails are configured to allow at least one of said plurality of projections on each of said sides of said housing to slide within said horizontal slot and said vertical slot and between said plurality of spaced notches of said first and second guide rails such that the position of said adjustable headrest relative to said spa can be adjusted.

16. The adjustable headrest of claim 13, wherein said first and second guide rails are substantially planar.

17. The adjustable headrest of claim 13, wherein said housing further comprises a plurality of raised annular surfaces on said first and second side surfaces of said housing wherein each of said plurality of raised annular surfaces surrounds one of said plurality of projections extending outwardly from said first and second side surfaces of said housing and wherein each of said plurality of raised annular surfaces is configured to reduce sliding friction by reducing the surface area of said first and second side surfaces in contact with said first and second guide rails.

18. The adjustable headrest of claim 13, wherein said waterjet comprises a nozzle which can be directionally adjusted.

19. The adjustable headrest of claim 13, wherein said housing can be positioned at a plurality of different fixed heights relative to said spa tub.

* * * * *